US011864665B2

(12) United States Patent
Wu et al.

(10) Patent No.: US 11,864,665 B2
(45) Date of Patent: Jan. 9, 2024

(54) HAMMOCK AND CRIB HAVING THE SAME

(71) Applicant: WONDERLAND SWITZERLAND AG, Steinhausen (CH)

(72) Inventors: Bo Wu, Guangdong (CN); Xiong Yu, Guangdong (CN); Cindy Reppert, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 31 days.

(21) Appl. No.: 17/500,587

(22) Filed: Oct. 13, 2021

(65) Prior Publication Data

US 2022/0110458 A1 Apr. 14, 2022

(30) Foreign Application Priority Data

Oct. 14, 2020 (CN) ..... 202011096258.8

(51) Int. Cl.
*A47D 7/03* (2006.01)
*A47D 15/00* (2006.01)

(52) U.S. Cl.
CPC ..... *A47D 7/03* (2013.01); *A47D 15/003* (2013.01)

(58) Field of Classification Search
CPC ..... A47D 15/00; A47D 7/03
See application file for complete search history.

(56) References Cited

U.S. PATENT DOCUMENTS 4,044,411 A * 8/1977 Peterson ..... A47D 13/063 5/99.1
5,867,850 A 2/1999 Mariol
9,155,402 B1 10/2015 Whitman
11,160,391 B2 11/2021 Schaffer et al.
2010/0138991 A1 6/2010 Hartenstine et al.
2016/0316934 A1* 11/2016 Kapanzhi ..... A47D 15/00
2017/0172312 A1 6/2017 Mohr
(Continued)

FOREIGN PATENT DOCUMENTS

CN 2678486 Y 2/2005
CN 2678487 Y 2/2005
CN 201370338 Y 12/2009
(Continued)

OTHER PUBLICATIONS

CN 110137937 Office Action dated May 19, 2022 with English Translation, 10 pages.
(Continued)

*Primary Examiner* — Robert G Santos
*Assistant Examiner* — Adam C Ortiz
(74) *Attorney, Agent, or Firm* — Quarles & Brady LLP

(57) ABSTRACT

The present disclosure provides a hammock including a hammock cloth body and a mattress. The hammock cloth body is configured to support the mattress. The mattress includes a first mattress and a second mattress that are connected to each other. The first mattress is foldable relative to the second mattress. A side of the hammock cloth body is provided with a pocket portion with an accommodation space. When the first mattress is folded and the pocket portion is connected to the first mattress, the accommodation space of the pocket portion is unfolded to form a storage space. The present disclosure further provides a crib including the above hammock.

15 Claims, 11 Drawing Sheets

(56) References Cited

U.S. PATENT DOCUMENTS

2018/0000256 A1* 1/2018 Saunders, Sr. ..... A47C 21/00

FOREIGN PATENT DOCUMENTS

| | | | | |
|---|---|---|---|---|
| CN | 101744476 | A | | 6/2010 |
| CN | 108185725 | A | * | 6/2018 |
| CN | 210842406 | U | | 6/2020 |
| CN | 210842406 | U | | 6/2020 |
| EP | 1552774 | B1 | | 7/2006 |
| JP | 38-18229 | Y | | 8/1938 |
| KR | 102251103 | B1 | * | 11/2019 |
| WO | WO-2021093890 | A1 | * | 5/2021 |

OTHER PUBLICATIONS

Japanese Office Action dated Nov. 4, 2022; Japanese Application No. 2021-167118.

* cited by examiner

HAMMOCK AND CRIB HAVING THE SAME

CROSS-REFERENCES TO RELATED APPLICATIONS

This disclosure claims priority to China Patent Application No. 2020110962588, filed on Oct. 14, 2020, and entitled "HAMMOCK AND CRIB WITH STORAGE SPACE", the content of which is hereby incorporated by reference in its entirety.

TECHNICAL FIELD

The present disclosure relates to the field of cribs, and more particularly to a hammock and a crib having the hammock.

BACKGROUND

Since an inner space of the crib has a large depth, it is inconvenient for the caregiver to take care of baby. Generally, the current crib is equipped with a hammock capable of being connected to the crib, and the hammock is mounted at an upper part of the crib to provide a play space for the baby and facilitate the caregiver to carry out or put in the baby.

However, the current hammock structure is only designed to have a single enclosed sleeping space, with no additional storage space. There are many personal items for babies, such as milk bottles, diapers, towels, clothing, toys and other items. Therefore, when using the above hammock without storage space, there is no extra space to use. Therefore, at present, almost all baby items are placed in a space formed between a lower part of the hammock and a play bed or a space under the play bed. However, placing the baby items in the space under the hammock is quite inconvenient to pick up the items. A user has to bend over and reach into the space under the hammock to get the placed items, which is quite inconvenient in use.

Therefore, it is necessary to provide a hammock that is capable of storing items and is convenient to take the items.

SUMMARY

According to some embodiments, a hammock and a crib having the hammock are provided.

The hammock includes a hammock cloth body and a mattress. The hammock cloth body is configured to carry the mattress. The mattress includes a first mattress and a second mattress that are connected to each other. The first mattress is foldable relative to the second mattress. A side of the hammock cloth body is provided with a pocket portion with an accommodation space. When the first mattress is folded and the pocket portion is connected to the first mattress, the accommodation space of the pocket portion is unfolded to form a storage space.

The crib includes a bed frame and the above hammock assembled on the bed frame.

The present disclosure will become clearer through the following description in conjunction with the accompanying drawings, which are used to explain the embodiments of the present disclosure.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION OF THE EMBODIMENTS

Figure 1:
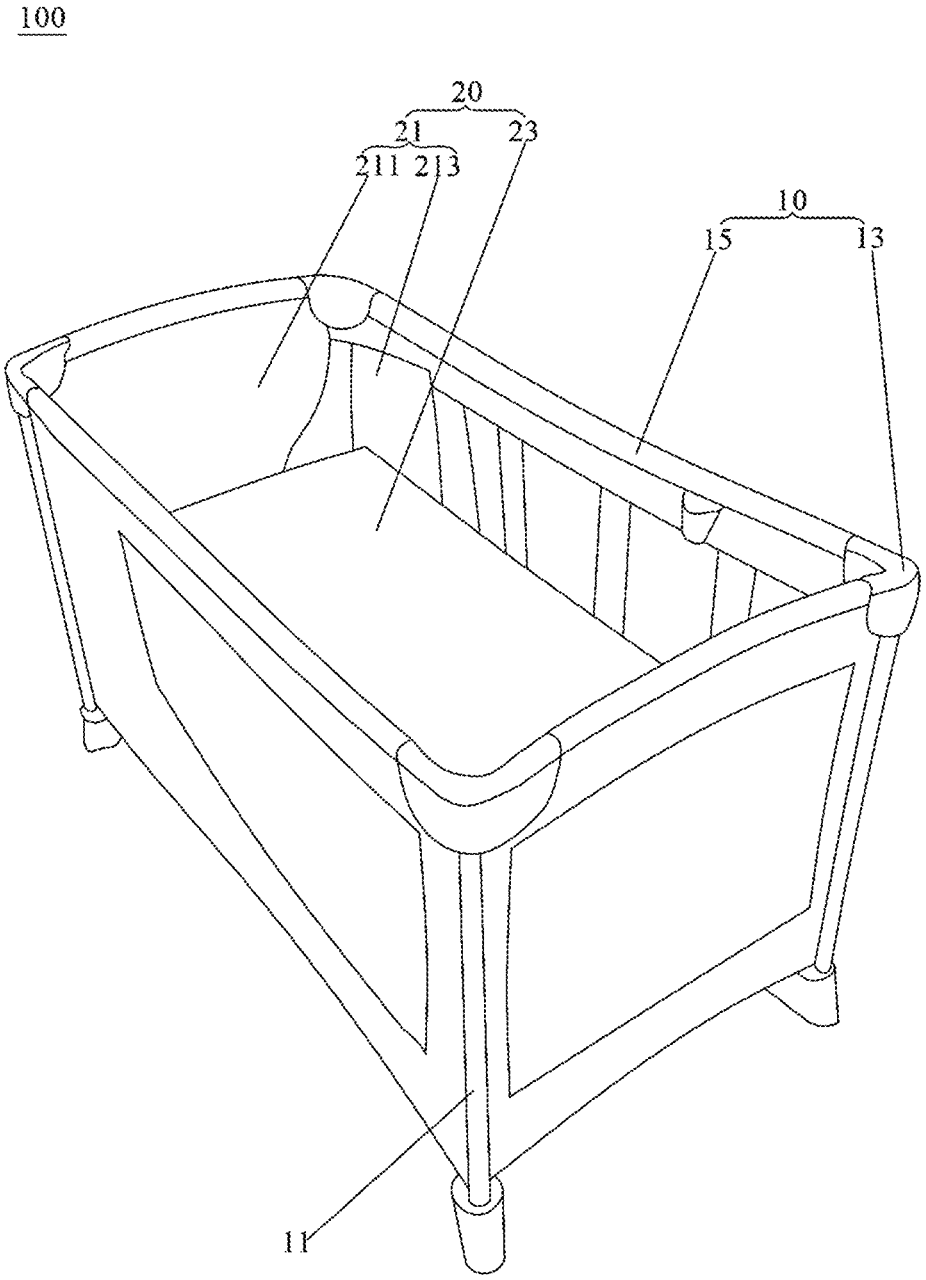
FIG. 1 is a schematic perspective view of a crib according to an embodiment.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 4:
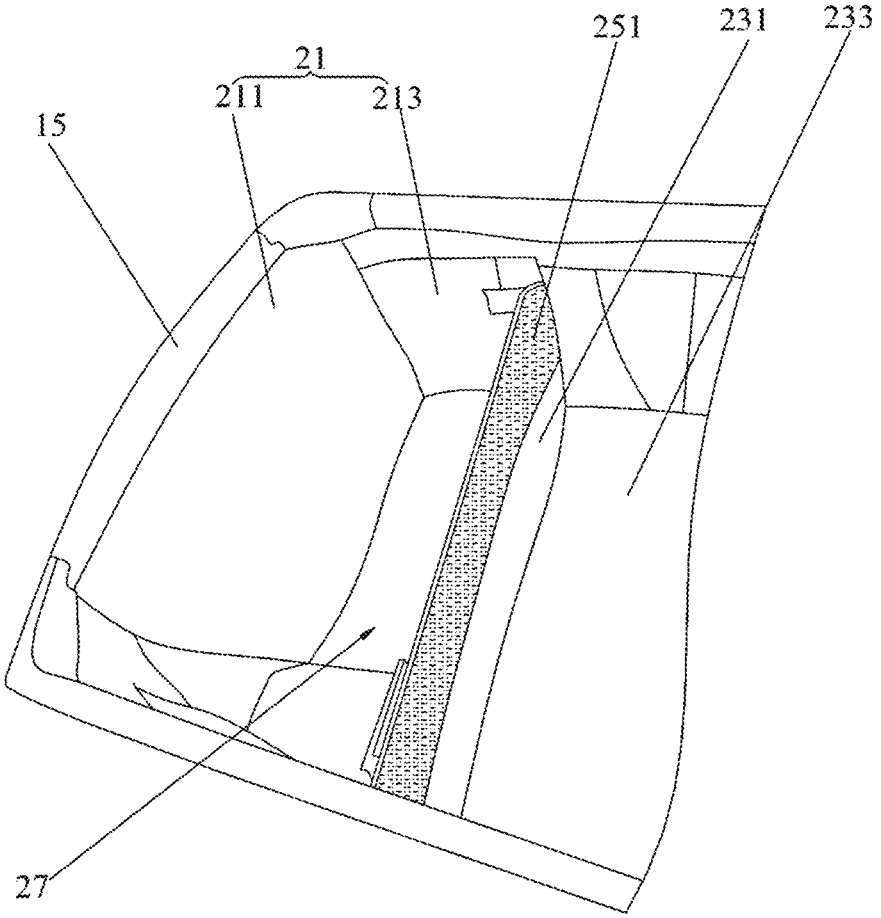
FIG. 4 is similar to FIG. 3, but illustrating the pocket portion is connected to the first mattress.

Referring to FIG. 1, a crib 100 according to an embodiment includes a bed frame 10, and a hammock 20 that is assembled on the bed frame 10. The hammock 20 has a storage space 27 (see FIG. 4), such that items can be placed in the storage space 27 during use of the crib 100, which is convenient for picking and placing items.

Specifically, the bed frame 10 includes four upright rods 11 extending in a vertical direction, four corner connectors 13 respectively disposed at a top end of each of the upright rods 11, and four side rods 15. Each side rod 15 is connected to a pair of adjacent corner connectors 13, and each side rod 15 is provided with a plastic hook (not shown) for fixing the hammock 20. It must be noted that the connection between the hammock 20 and the bed frame 10 is familiar for those skilled in the art. For the sake of brevity, related descriptions are omitted in the description.

Figure 2:
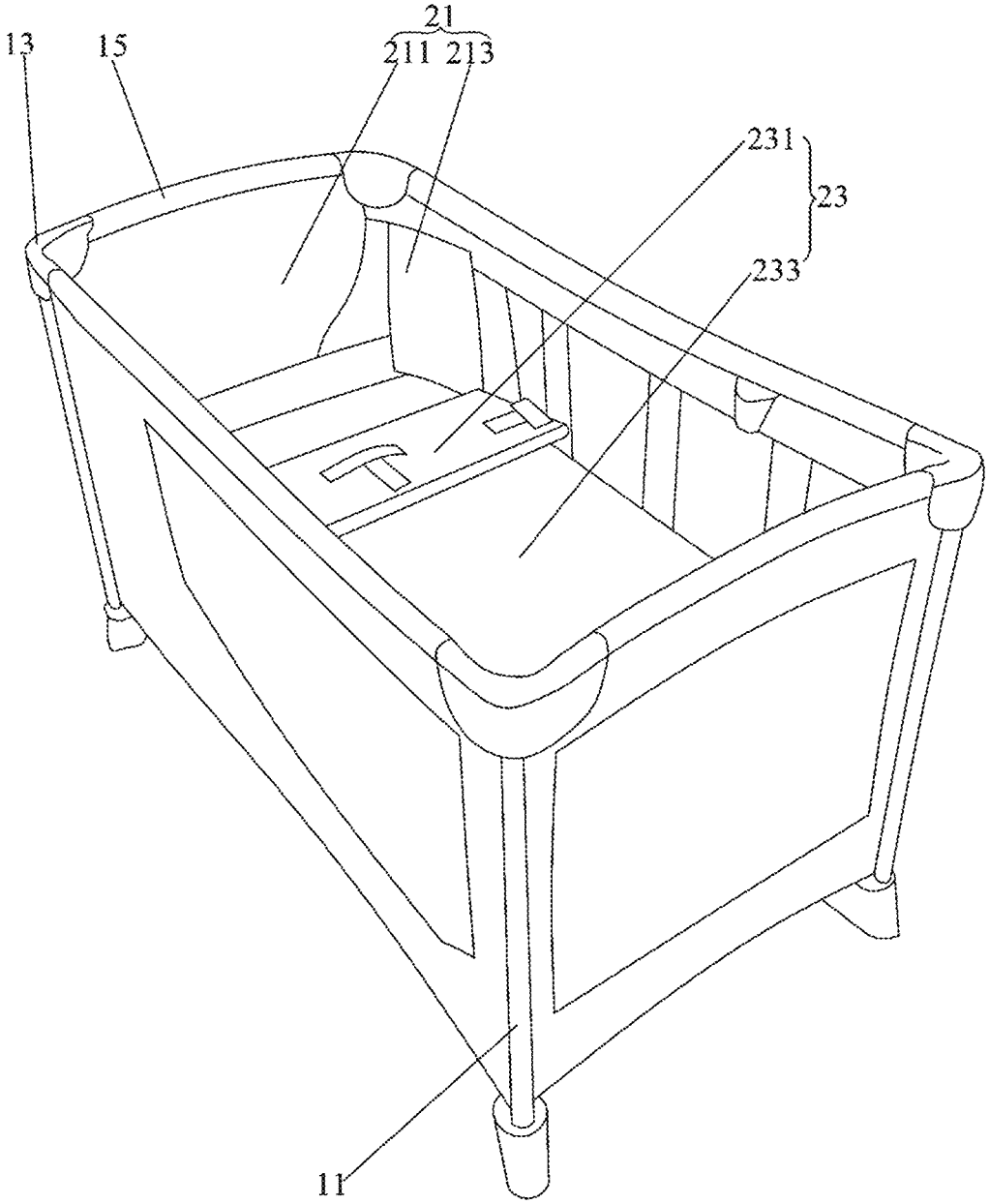
FIG. 2 is similar to FIG. 1, but illustrating the first mattress is folded relative to the second mattress.

Referring to FIGS. 1 to 2, the hammock 20 includes a hammock cloth body 21 and a mattress 23. The hammock cloth body 21 is used to support the mattress 23. In this embodiment, the hammock cloth body 21 is fixed to the bed frame 10 by a hook, and the mattress 23 is located in the hammock cloth body 21. The mattress 23 includes a first mattress 231 and a second mattress 233 that are connected to each other. The first mattress 231 is foldable relative to the second mattress 233. A side of the hammock cloth body 21 is provided with a pocket portion 25 having an accommodation space. When the first mattress 231 is folded and the pocket portion 25 is connected to the first mattress 231, the accommodation space of the pocket portion 25 is unfolded to form the storage space 27. In other words, when the first mattress 231 is folded relative to the second mattress 233, a side of the pocket portion 25 is connected to the first mattress 231, such that the accommodation space of the pocket portion 25 can be unfolded to form the storage space 27. It should be understood that the storage space 27 is formed between a side of the first mattress 231 facing the pocket portion 25 and the hammock cloth body 21, and an area of the second mattress 233 is used for a baby to sleep, such that the hammock 20 is divided into a sleeping space and the storage space 27 by the mattress 231. Even if the baby lies on the hammock 20, the user can still place the baby items in the storage space 27 of the hammock 20. Since the storage space 27 and the baby sleeping space are located on the same plane on a bottom surface of the hammock 20, the user can conveniently take the items placed in the storage space 27. In this embodiment, the first mattress 231 is vertically arranged when folded relative to the second mattress 233. Of course, the first mattress 231 may also have other angles, such as 60 degrees or 120 degrees, but it is not limited hereto.

Figure 3:
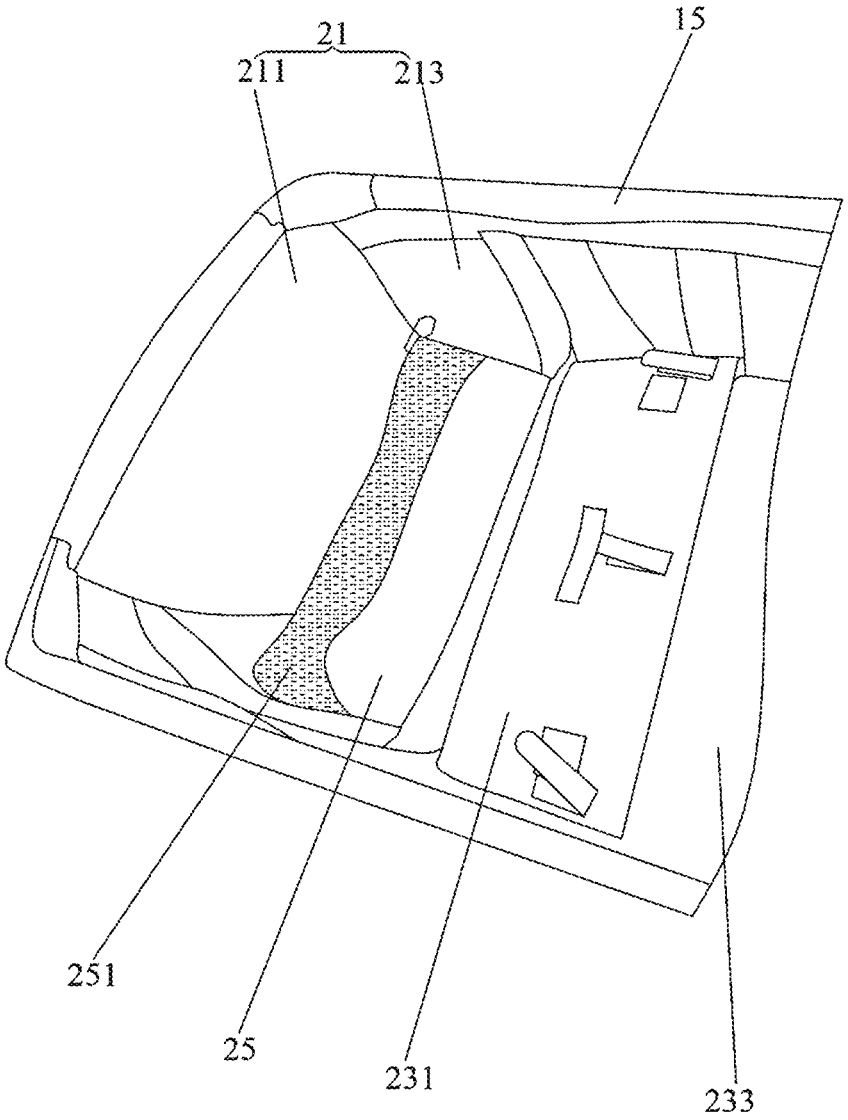
FIG. 3 is a partial enlarged view of FIG. 2 viewed from another aspect.

Referring to FIGS. 2 to 3, the hammock cloth body 21 includes a pair of first side cloth bodies 211 spaced apart and a pair of the second side cloth bodies 213 spaced apart and connected to the first side cloth bodies 211. An end of the pocket portion 25 is connected to the first side cloth body 211, and the other end of the pocket portion 25 may be connected to the first mattress 231 (see FIG. 4). The pocket portion 25 is capable of being folded to the bottom of the hammock, and the pocket portion 25 has an accommodation space when it is unfolded. The pocket portion 25 has a shape of a pocket. An end of the pocket portion 25 is connected to the first side cloth body 211. When the pocket portion 25 is unfolded, the other end of the pocket portion 25 is connected to the first mattress 231, the pocket of the pocket portion 25 is opened to form the storage space 27 for storing. When the pocket of the pocket portion 25 is folded, the pocket portion 25 can be attached to the bottom of the hammock without occupying much space. Furthermore, the pocket portion 25 is provided with a sleeving portion 251 having an opening, which is configured to be sleeved on the first mattress 231. During use, the sleeving portion 251 is sleeved directly on the first mattress 231 that has been folded, such that the pocket portion 25 is conveniently sleeved on the first mattress 231.

Figure 5:
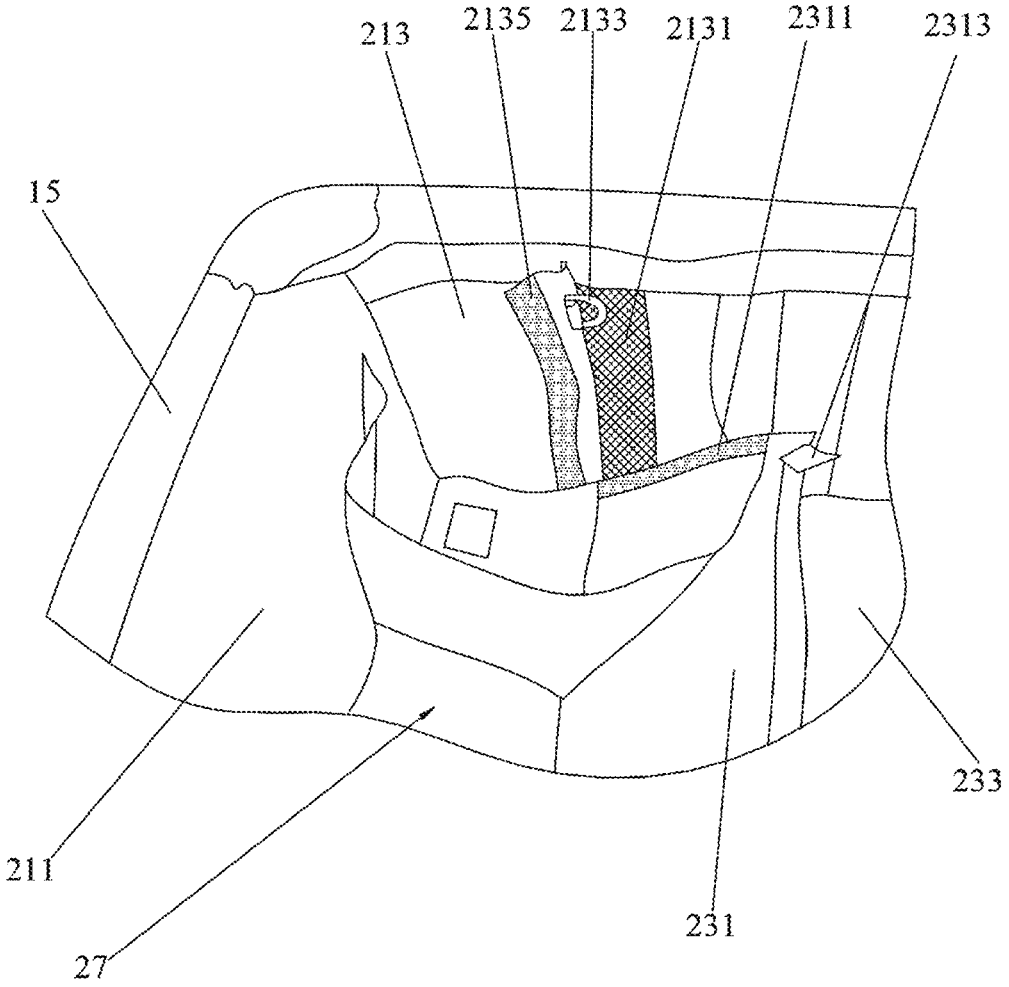
FIG. 5 is a schematic view illustrating a connection relationship between the first velcro and the second velcro.

Referring FIG. 5, the second side cloth body 213 is provided with a first velcro 2131, and the pocket portion 25 is provided with a second velcro 2311 that matches the first velcro 2131. The first mattress 231 is positioned by bonding the first velcro 2131 to the second velcro 2311. When the first mattress 231 is folded to a certain position relative to the second mattress 233, the second velcros 2311 on both sides of the pocket portion 25 and the two first velcros 2131 provided on the first side cloth body 213 can be bonded with each other to position the first mattress 231. In order to firmly fix the first mattress 231, the second side fabric 213 is provided with a connecting portion 2133, the pocket portion 25 is provided with a connecting belt 2313. The connecting belt 2313 is connected to the connecting portion 2133 to fix the first mattress 231. In this embodiment, the connecting portion 2133 is a D-ring, and the connecting belt 2313 is a webbing belt with a velcro. When the first mattress 231 is folded to a certain position relative to the second mattress 233, an end of the webbing belt extends through the D-ring and is bonded to itself to fix the first mattress 231, which is very convenient.

Figure 6:
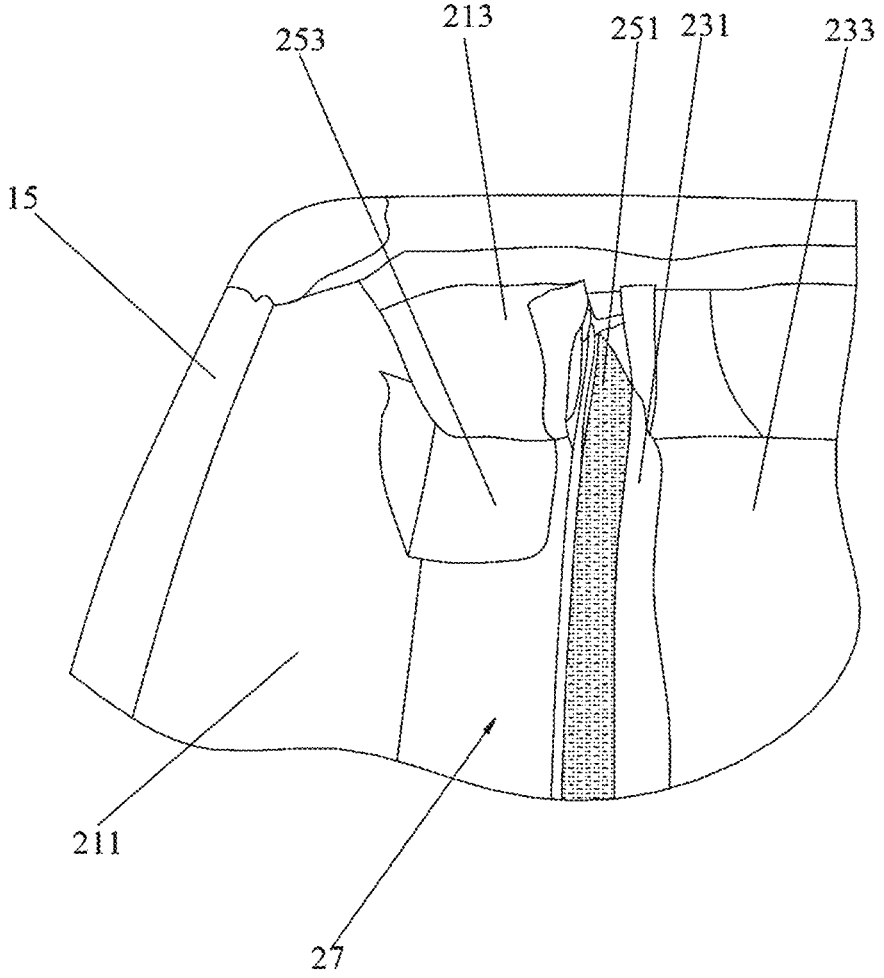
FIG. 6 is a schematic view illustrating that the accessories are folded as a compact form and stored in the pocket portion.
Figure 7:
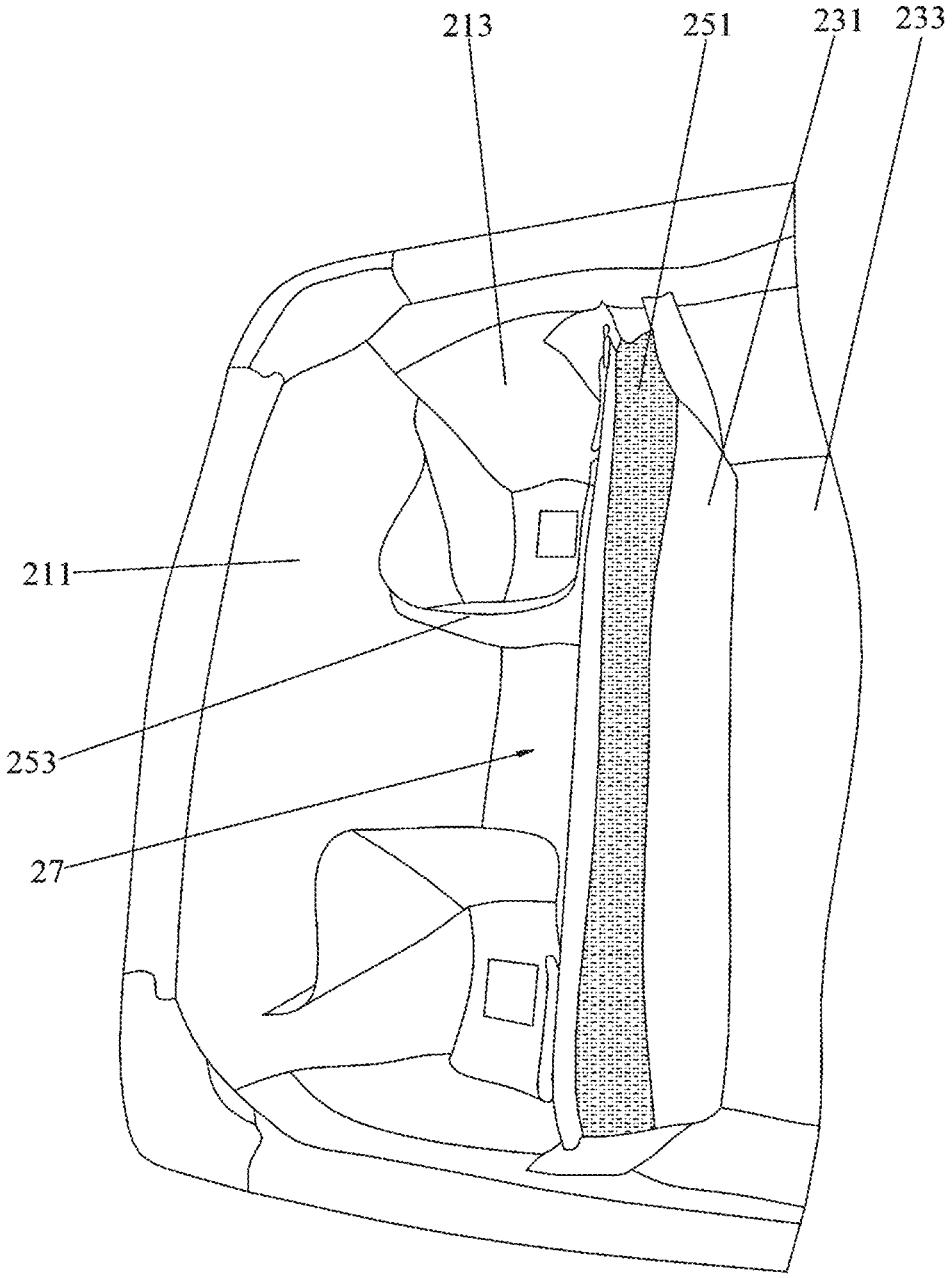
FIG. 7 is a schematic view illustrating that the accessories shown in FIG. 6 are unfolded.
Figure 8:
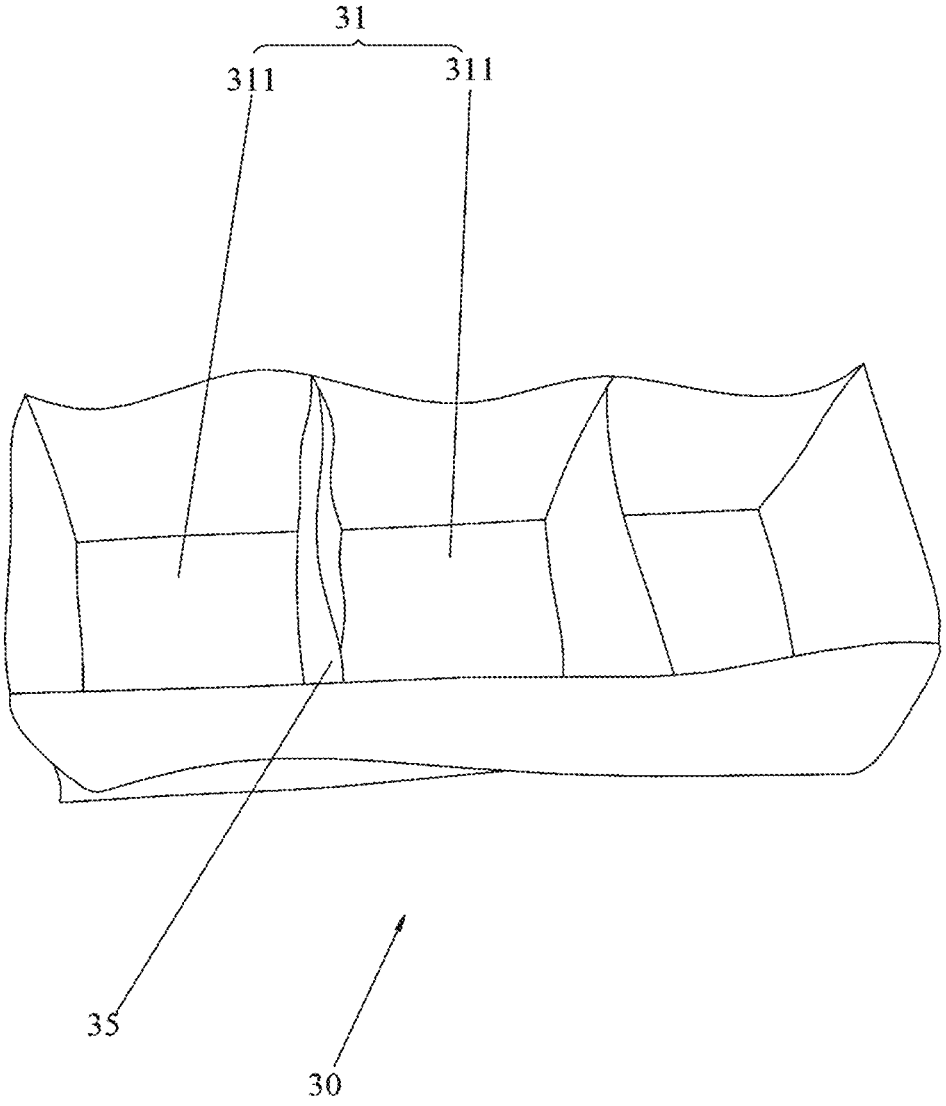
FIG. 8 is a schematic view of the storage portion.
Figure 9:
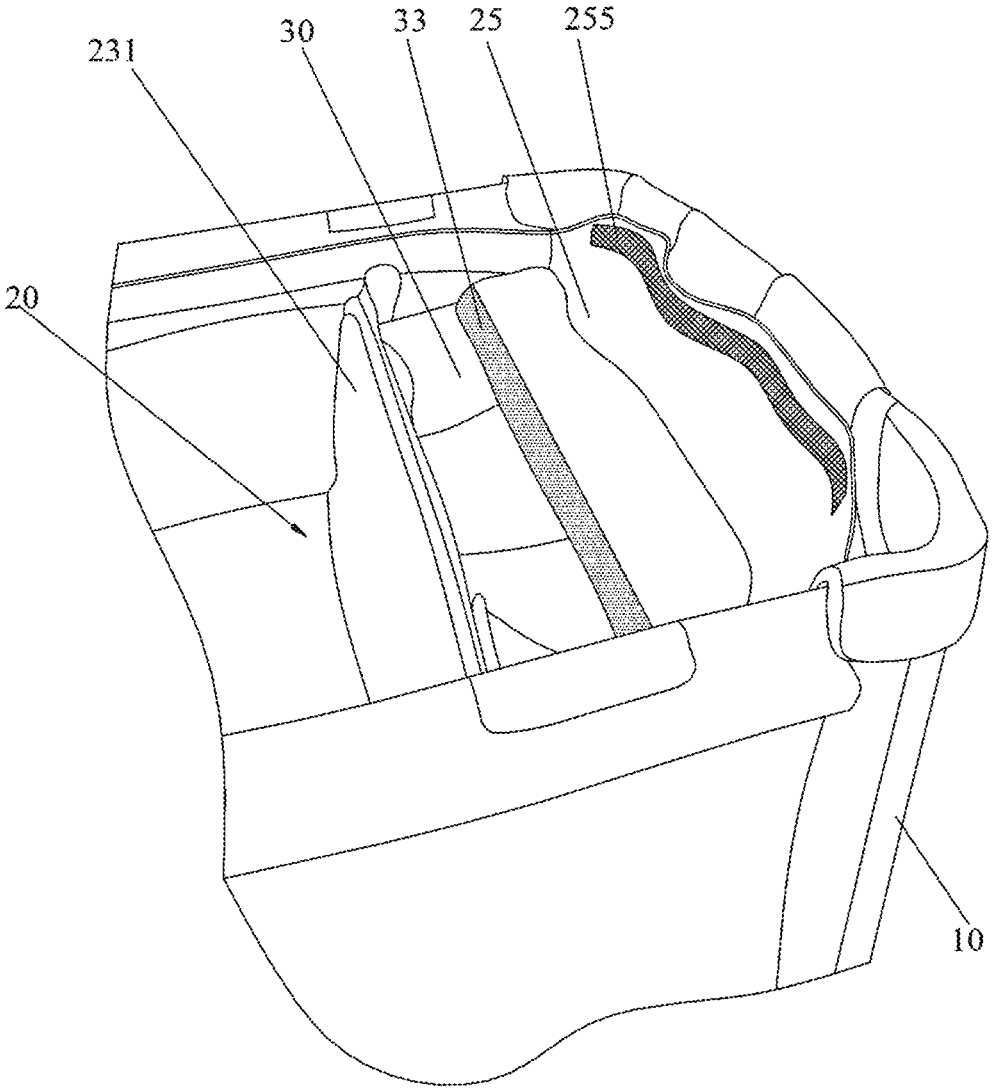
FIG. 9 is a schematic view illustrating the storage portion located in the storage space, where the first bonding portion and the second bonding portion are not connected.
Figure 10:
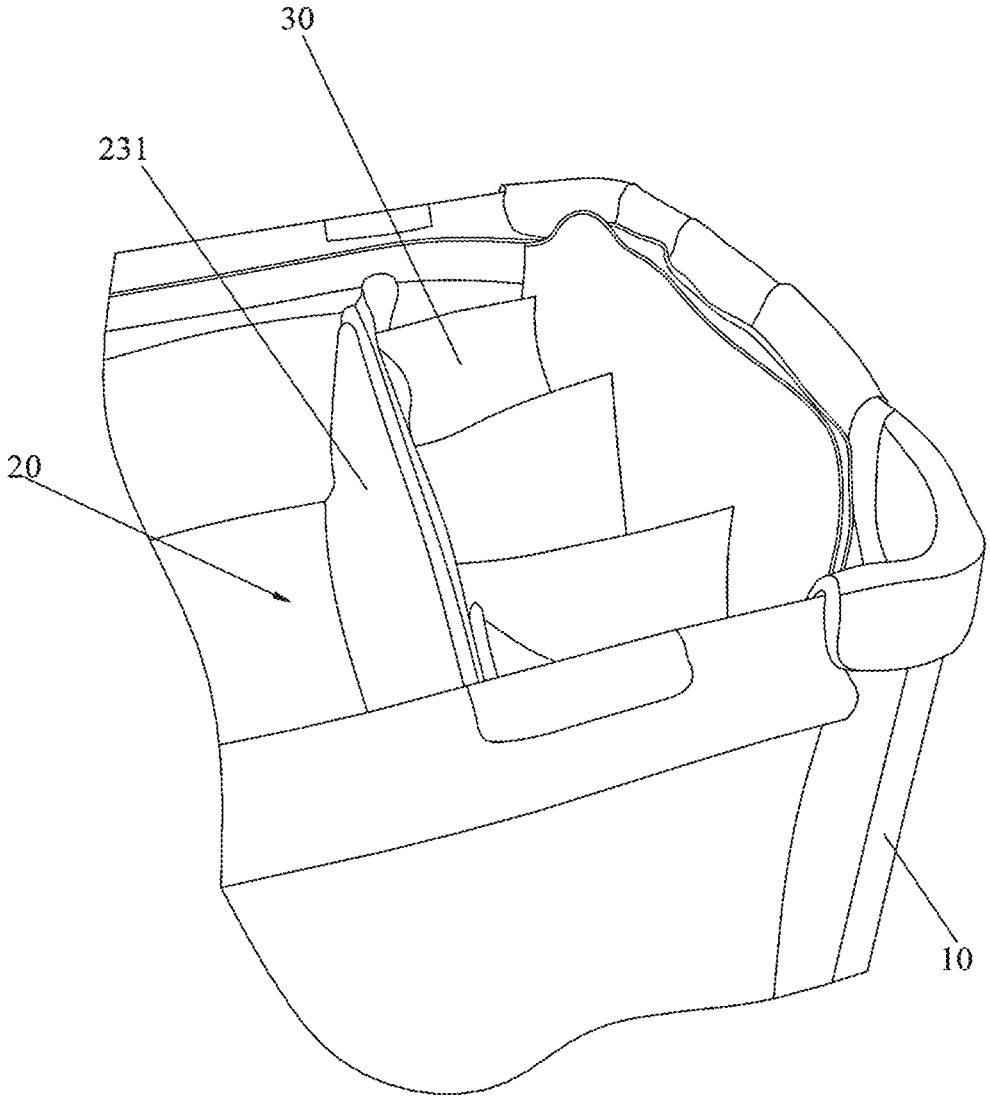
FIG. 10 is a schematic view illustrating the storage portion located in the storage space, where the first bonding portion and the second bonding portion are bonded.
Figure 11:
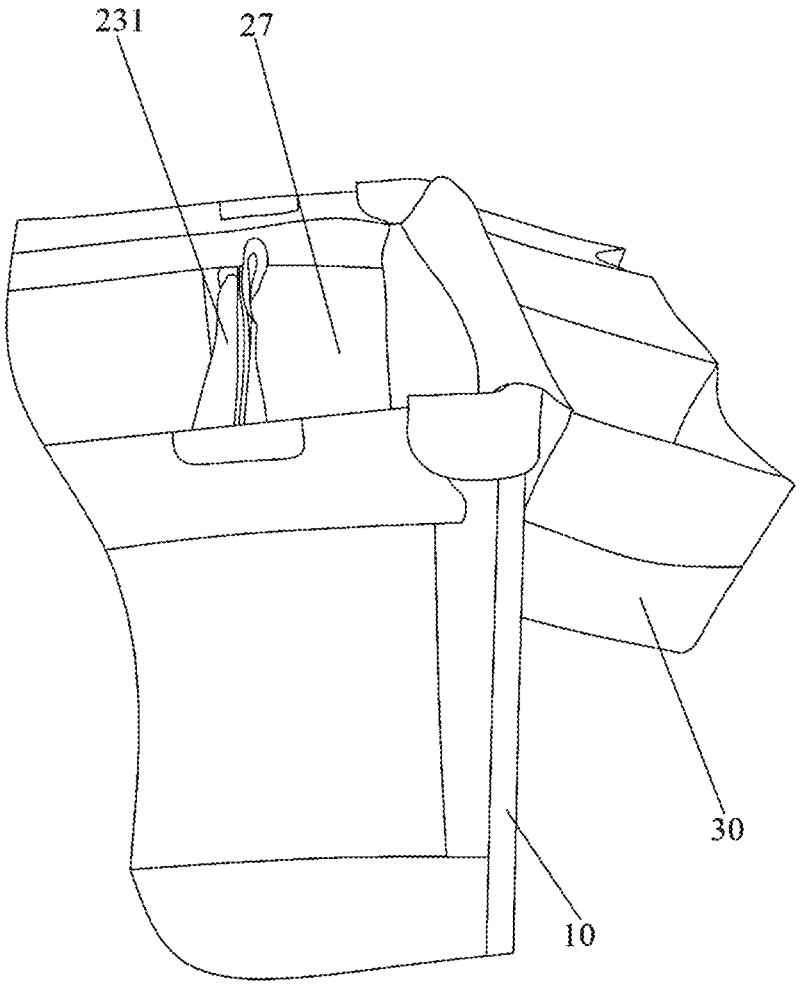
FIG. 11 is a schematic view illustrating the storage portion is located outside the crib.

Referring to FIGS. 6 to 7, the pocket portion 25 has at least one accessory 253. An end of each of the plurality of accessories 253 is connected to the second side cloth body 213. Each of the plurality of accessories 253 is capable of being folded as a compact form to be stored in a lower portion of the pocket portion 25. When the accessories 253 are used, the accessories 253 can be unfolded to divide the storage space 27 into a plurality of sections. In other words, when the accessory 253 is unfolded, the storage space 27 can be divided, and the accessory 253 and the second side cloth body 213 cooperatively enclose a pocket-like area. When the accessory 253 is folded, it can be stored at the bottom of the hammock. In this embodiment, each of the opposite second side cloth bodies 213 is provided with the accessory 253. The unfolded accessories 253 are in the shape of pocket, such that after the accessories 253 on both ends are unfolded, the storage space 27 is divided into three sections, which is convenient for sorting of items. At the same time, in order to increase the support strength of the accessories 253, a polyethene (PE) board (not shown) is provided in each of the accessories 253, and the accessories 253 is capable of standing upright by installing the PE board in the each of the accessories 253. Further, referring to FIG. 5, the second side cloth body 213 is provided with a cover sheet 2135 that can be bonded to the first velcro 2131. When the storage space 27 is not required, the first mattress 231 and the second mattress 233 are placed horizontally, and the cover sheet 2135 is bonded to the first velcro 2131 to prevent the first velcro 2131 from being in contact with baby.

Referring to FIGS. 8 to 11, in another embodiment of the present disclosure, the hammock 20 further includes a storage portion 30 having an accommodation cavity 31 configured to accommodate the items. A side of the pocket portion 25 is provided with a first bonding portion 255, and the storage portion 30 is provided with a second bonding portion 33. Bonding the first bonding portion 255 to the second bonding portion 33 allows the storage portion 30 to be fixed in the storage space 27. That is, the storage portion 30 is placed in the storage space 27, and the bonding portion 255 and the second bonding portion 33 are connected to fix the storage portion 30 in the storage space 27, such that the items can be placed in the accommodation cavity 31. When the storage portion 30 is used for a period of time, it should be cleaned. Since the storage portion 30 is easy to be detached, it is advantageous for cleaning. Further, the accommodation cavity 31 is divided into a plurality of accommodation units 311 by a plurality of partitions 35, and the plurality of accommodation units 311 can accommodate different types of items. Furthermore, a side of the pocket portion 25 away from the first mattress 231 is provided with the first bonding portion 255. Bonding the first bonding portion 255 to the second bonding portion 33 allows the storage portion 30 to be located outside the storage space 27. When the hammock 20 is assembled on the bed frame 10, since the first bonding portion 255 is adjacent to the bed frame 10, the second bonding portion 33 is bonded to the first bonding portion 255, and the bed frame 10 is used as a support, such that the storage portion 30 is connected to the outside of the crib 100 and does not need to be placed in the storage space 27. As a result, the storage space 27 and the storage portion 30 can be utilized at the same time, and the storage capacity is increased.

Hereinafter, the working principle of the hammock 20 will be described in greater detail with reference to FIGS. 1 to 11.

When the storage space 27 needs to be used, the first mattress 231 is folded relative to the second mattress 233, and the first mattress 231 is positioned by bonding of the first velcro 2131 and the second velcro 2311. The first mattress 231 is then fixed by connecting the connecting belt 2313 to the connecting portion 2133, the pocket portion 25 is operated to unfolded and the sleeving portion 251 is sleeved on the upper portion of the first mattress 231, such that the accommodation space of the pocket portion 25 is unfolded to form the storage space 27 for storing. Further, the accessories 253 can be unfolded to divide the storage space 27 into three sections. When the storage space 27 are not required, the above operation can be reversed, which will not be repeated in detail herein.

Compared with the prior art, since the first mattress 231 is foldable relative to the second mattress 233, when the first mattress 231 is folded, the side of the pocket portion 25 connected to the first mattress 231 forms the storage space 27, an area of the second mattress 233 forms a sleeping space for the baby. The baby lies on the area of the second mattress 233 of the hammock 20, and a user may place baby items in the storage space 27 of the hammock 20. Since the storage space 27 and the sleeping space for the baby are located on the same plane on the bottom surface of the hammock 20, the user may easily take the baby items without a need for the user to bend over and reach into the space under the hammock 20 to get the placed items.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter.

What is claimed is:

1. A hammock, comprising:

a mattress comprising a first mattress and a second mattress that are connected to each other, the first mattress being foldable relative to the second mattress; and a hammock cloth body configured to support the mattress, a side of the hammock cloth body being provided with a pocket portion having an accommodation space, wherein when the first mattress is folded and the pocket portion is connected to the first mattress, the accommodation space of the pocket portion is unfolded to form a storage space.

2. The hammock of claim 1, wherein the pocket portion is provided with a sleeving portion having an opening, the sleeving portion is configured to be sleeved on the first mattress.

3. The hammock of claim 1, wherein the hammock cloth body comprises a first side cloth body and a second side cloth body connected to the first side cloth body, and an end of the pocket portion is connected to the first side cloth body and is capable of being folded on the first side cloth body.

4. The hammock of claim 3, wherein the second side cloth body is provided with a first hook and loop fastener, the first mattress is provided with a second hook and loop fastener matching the first hook and loop fastener and the first mattress is positioned by bonding the first hook and loop fastener and the second hook and loop fastener.

5. The hammock of claim 3, wherein the second side cloth body is provided with a connecting portion, the first mattress is provided with a connecting belt, and the connecting belt is connected to the connecting portion to fix the first mattress.

6. The hammock of claim 4, wherein the second side cloth body is provided with a connecting portion, the first mattress is provided with a connecting belt, and the connecting belt is connected to the connecting portion to fix the first mattress.

7. The hammock of claim 5, wherein the connecting portion is a D-ring.

8. The hammock of claim 5, wherein the connecting belt is a webbing belt with a hook and loop fastener.

9. The hammock of claim 3, wherein the pocket portion has at least one accessory, an end of the at least one accessory is connected to the second side cloth body, the at least one accessory is capable of being folded as a compact form to be stored in the pocket portion, the at least one accessory is further capable of being unfolded to divide the storage space into a plurality of sections.

10. The hammock of claim 9, wherein a polyethene (PE) board is provided in the at least one accessory.

11. The hammock of claim 4, wherein the second side cloth body is provided with a cover sheet bonded to the first hook and loop fastener.

12. The hammock of claim 1, further comprising a storage portion having a accommodation cavity, wherein a side of the pocket portion is provided with a first bonding portion, the storage portion is provided with a second bonding portion, and the storage portion is fixed in the storage space by bonding the first bonding portion to the second bonding portion.

13. The hammock of claim 12, wherein the accommodation cavity comprises a plurality of accommodation units.

14. The hammock of claim 12, wherein a side of the pocket portion away from the first mattress is provided with a first bonding portion, and the storage portion is located outside the storage space by bonding the first bonding portion to the second bonding portion.

15. A crib, comprising a bed frame and the hammock according to claim 1 assembled on the bed frame.

* * * * *